United States Patent [19]

Economopoulos et al.

[11] 4,016,009

[45] Apr. 5, 1977

[54] PRODUCING ROLLED STEEL PRODUCTS

[75] Inventors: Mario Economopoulos, Liege; Jean Yves Respen, Herstal, both of Belgium

[73] Assignee: Centre de Recherches Metallurgiques-Centrum voor Research in de Metallurgie, Brussels, Belgium

[22] Filed: Jan. 29, 1976

[21] Appl. No.: 653,607

[30] Foreign Application Priority Data

Jan. 29, 1975 Belgium ..... 824960
Feb. 28, 1975 Belgium ..... 826201

[52] U.S. Cl. ..... 148/12 B; 148/145; 148/156

[51] Int. Cl.[2] ..... C21D 9/52

[58] Field of Search ..... 148/12 B, 145, 156

[56] References Cited

UNITED STATES PATENTS

| | | | |
|---|---|---|---|
| 2,756,169 | 7/1956 | Corson et al. | 148/134 |
| 3,011,928 | 12/1961 | Kopec et al. | 148/156 |
| 3,735,966 | 5/1973 | Hoffmann | 148/156 |

*Primary Examiner*—W. Stallard
*Attorney, Agent, or Firm*—Holman & Stern

[57] ABSTRACT

In the rolling mill the temperature of the product is reduced to between $Ac_3$ and $Ac_3 + 150°$ C before it enters the finishing stands. The product emerging from the finishing stands is quenched to provide a surface layer of martensite and/or bainite. Subsequently the heat of the core of the product is allowed to raise the temperature of the surface layer to between 450° and 750° C, so that the quenched layer is tempered.

10 Claims, No Drawings

PRODUCING ROLLED STEEL PRODUCTS

The present invention relates to a method of producing rolled steel products, particularly reinforcing rods or bars. Although in the following text specific reference is made to rods, the method in question is applicable to numerous types of sections (wire rod, merchant bar, etc.), whether of killed steel, balanced (semi-killed) steel, or rimming steel.

The main qualities required by users of steel rod are, among other things, as high as possible an elastic limit for the kind of steel used, as well as satisfactory weldability, fatigue strength, and ductility for the use to which the rod is to be put. On the other hand, in order to improve the weldability and ductility of a steel, it is necessary to decrease its carbon and manganese content, which concurrently results in a decrease of its tensile strength. To remedy this inconvenience, the steel can be subjected to a suitable cooling treatment, which permits the elastic limit of the rod to be raised to a certain extent.

However, when rod (particularly concrete reinforcing rod) is cooled by convection or radiation, the way in which the rolled product cools depends almost entirely on the diameter of the rod, so that, for rod of a given diameter, it is necessary to make use of other procedures for complementing the mere cooling action in order to modify its elastic limit. Among these procedures, reference should be made in particular to the addition of dispersoid elements (Nb, V) which cause grain refinement and precipitation hardening of the ferrite.

In order to decrease the austenitic grain size, it has been suggested to subject steel rod, during rolling, to intermediate cooling down to a temperature lower than $A_3$, before the rod enters the finishing stands of the rolling mill. On emerging from the finishng stands, the rod undergoes rapid cooling in a suitable cooling installation to a temperature of 700° C to 800° C, and then slower cooling.

It has been also suggested to cool a steel rod, after it has emerged from the final stand of the rolling mill, by means of a fluid so as to cause martensitic and/or bainitic quenching of the surface of the rod. According to this procedure, upon emerging from the fluid cooling installation, the unquenched part of the rod is at a temperature sufficient to allow tempering of the surface layer of martensite and/or bainite to take place (during air-cooling) due to the heat of the core of the rod, whereby the rod progressively assumes a ferritic or ferritic-pearlitic structure, or possibly even a pearlitic-bainitic structure. In this way, a product of composite structure is obtained.

The cooling fluid employed for carrying out such a procedure is usually water with or without conventional additives. However, it is also possible to use a gas such as steam blown at high speed, possibly at supersonic speed, onto the rod.

The quenching and self-tempering procedure just described, improves the mechanical properties of the rod to a substantial extent, particularly as far as the elastic limit is concerned.

The present invention relates a method capable of further improving to a substantial extent the results obtained by the above-mentioned procedures. Moreover, the quality of the rod may be improved without increasing the carbon and manganese contents unacceptably from the weldability viewpoint.

In the method according to the invention the product, before entering the finishing stands of a rolling mill, undergoes a cooling treatment by means of a suitable fluid (such as water), the cooling step being preferably followed by homogenisation of the temperature of the product so that the product, upon entering the finishing stands, is brought to a substantially uniform temperature between $A_3$ and $Ac_3 + 150°$ C, and preferably to a temperature above and as close as possible to $Ac_3$; the product, after emerging from the finishing stands, undergoes quenching which results in a martensitic and/or bainitic surface of the product; and the conditions of the said quenching are adjusted in such a way that the central part of the product, at the outlet of the cooling area, is at a temperature such that the tempered surface thereof undergoes natural reheating due to the heat from the core, and the surface part, at the end of the said natural reheating, attains a temperature of 450° C to 750° C (preferably of 550° C to 700° C), which results in tempering of the quenched surface. On the other hand, quenching of the product at the outlet of the last finishing stand together with rolling at low temerature by cooling the rods before entering the finishing stands cause the transformation of austenite into fine-grained ferrite and carbides in the central part of the product.

In the following description the product is referred to as "rod".

According to the method of the present invention, it is possible to obtain a rod having a composite structure whose periphery is constituted by martensite and/or bainite throughout a thickness which could be relatively large (2 mm, for example), the core consisting of very fine grained pearlite. The rod thus obtained has a particularly high tensile strength, elastic limit, and weldability.

Preferably, the martensitic and/or bainitic surface layer has a thickness such that the cross-sectional area of the part consisting of martensite and/or bainite amounts to 10 to 50% (preferably 15 to 35%) of the total cross-sectional area of the rod.

From a practical point of view, the desired cooling of the rod is performed by suitably choosing cooling apparatuses and by suitably adjusting the length and the location of such apparatuses (a sprayer, for example); in particular, the cooling devices are arranged as close as possible to the outlet of the finishing stand, whereas the intermediate cooling installation is located between the stands and immediately preceding the finishing stands and has its cooling device as close as possible to the stands immediately preceding the finishing stands in order to leave a gap sufficient for the homogenisation of the temperature of the rod to take place.

It has been found to be advantageous to carry out in several steps both the cooling of the rod at the outlet of the rolling mill and the cooling of the rod before entering the finishing stands. In this way, it is possible to save water at the outlet of the finishing stands and to increase the homogeneity in the temperatures of the rod before entering the finishing stands.

Although the mechanical properties of the rod, independently of the quenching conditions applied to the rod, are improved with respect to rods which have not been subjected to the treatment of the invention, it has been found that for a given dwelling time in the cooling area the improvement increases with the heat transfer coefficient of the cooling installation used. Conversely, the heat transfer coefficients being equal, the improvement increases with the dwelling time in the quenching area.

The method according to the invention permits one to obtain properties which are improved, specifically as far as the elastic limit is concerned, to an extent higher than the sum of the improvements individually obtained in each of the steps of the method.

The following examples are intended to illustrate quantitatively the improvements mentioned above, which give the method the indisputable character of a combination whose results were unforseeable and are still unexplained.

EXAMPLE 1

Rod with a diameter of 20 mm of balanced steel containing 0.30% C, 1.06% Mn, and 0.08% Si, emerging from a rolling mill at a speed of 11.3 m/s, was treated in various ways. The following comparative Table I gives the characteristics of the rod in the following states:

column 1: natural cooling at the outlet of the rolling mill, column 2: only cooling before entering the finishing stands, column 3: only surface quenching and tempering at the outlet of the rolling mill, column 4: combination of the treatments in columns 2 and 3.

TABLE I

| | 1 | 2 | 3 | 4 |
|---|---|---|---|---|
| Temperature (° C) at the outlet of the rolling mill | 1055 | 895 | 1055 | 895 |
| Elongation % | 25 | 24 | 23 | 19 |
| Ultimate tensile stress (kg/mm²) | 56.4 | 55.7 | 61.5 | 69.8 |
| Elastic limit kg/mm² | 35.7 | 37.7 | 46.5 | 57.5 |
| Improvement kg/mm² | — | 2 | 10.8 | 21.8 |

Comparison of the improvements indicates that those under column 4 are considerably higher than the sum of those under columns 2 and 3. It was also found that the improvements increased with the length of the cooling installation and the rate of supply of quenching water.

EXAMPLE 2

Steel rod with a diameter of 20 mm, containing 0.18% C, 1.29% Mn, 0.035% Nb, and 0.08% Si, was subjected to the same operations as those referred to in Example 1.

The results obtained are reported in the following Table II. The same comments as those made in connection with Table I apply to the results shown in Table II.

TABLE II

| | 1 | 2 | 3 | 4 |
|---|---|---|---|---|
| Temperature ° C at the outlet of the rolling mill | 1065 | 900 | 1065 | 900 |
| Elongation% | 28 | 27 | 19 | 18 |
| Ultimate tensile stress (kg/mm²) | 52.3 | 54.6 | 63.4 | 67.3 |
| Elastic limit (kg/mm²) | 37.9 | 40 | 52 | 60.8 |

TABLE II-continued

| | 1 | 2 | 3 | 4 |
|---|---|---|---|---|
| Improvement kg/mm² | — | 2.1 | 14.1 | 22.9 |

EXAMPLE 3

This example deals with steel rod with a diameter of 16mm, containing 0.20% C, 1.41% Mn, and 0.09% Si, and emerging from the rolling mill at a speed of 12.5 m/s. The remaining conditions were as in Example 1. The results obtained are shown in Table III.

TABLE III

| | 1 | 2 | 3 | 4 |
|---|---|---|---|---|
| Temperature ° C at the outlet of the rolling mill | 1100 | 870 | 1100 | 870 |
| Elongation % | 25 | 26 | 22 | 16 |
| Ultimate tensile stress (kg/mm²) | 56.9 | 56.5 | 60.3 | 69.5 |
| Elastic limit kg/mm² | 37.6 | 38.8 | 47 | 59.1 |
| Improvement kg/mm² | — | 1.2 | 9.4 | 21.5 |

In other words, the above mentioned results lead to the following conclusions:

a. If one performs only cooling of the rod before it enters the finishing stands, the elastic limit of the rod increases but little (3kg/mm² for a decrease of 115° C at the outlet of the rolling mill, for example).

b. On the other hand, if one combines the two cooling operations before and after the finishing stands, there is obtained a substantial increase in the elastic limit of the rod. Moreover, when cooling the rod before the finishing stands, other things (particularly the results obtained) being equal, it is possible to considerably reduce the consumption of cooling water and the length of the cooling installation (respectively by 16% and 44% in the case where the temperature of the rod at the outlet of the rolling mill is lowered by 115° C) which would be needed for cooling only after the finishing stands.

We claim:

1. A method of producing a rolled steel product in a rolling mill including finishing stands, the method comprising the steps of reducing the temperature of the product, before it enters the finishing stands, to a value between $Ac_3$and $Ac_3 + 150°$ C; quenching the product emerging from the finishing stands, thereby forming a quenched surface comprising martensite and/or bainite, the product still having an unquenched core; and allowing heat from the core to raise the temperature of the quenched surface to a value between 450° and 750° C, whereby the quenched surface is tempered.

2. A method as claimed in claim 1, in which the product enters the finishing stands at a temperature just above $Ac_3$.

3. A method as claimed in claim 1, in which the heat from the core raises the temperature of the quenched surface to a value between 550° and 700° C.

4. A method as claimed in claim 1, in which the step of reducing the temperature of the product before it enters the finishing stands comprises a cooling step followed by a temperature homogenisation step.

5. A method as claimed in any of claims 1 to 4, in which the cross-sectional area of the quenched surface occupies 10 to 50% of the total cross-sectional area of the product.

6. A method as claimed in claim 5, in which the cross-sectional area of the quenched surface occupies 15 to 35% of the total cross-sectional area of the product.

7. A method as claimed in claim 1, in which the step of reducing the temperature of the product before it enters the finishing stands comprises cooling with water.

8. A method as claimed in claim 1, in which the step of quenching comprises cooling with water.

9. A method as claimed in claim 1, in which the step of reducing the temperature of the product before it enters the finishing stands is carried out in several stages.

10. A method as claimed in claim 1, in which the quenching step is carried out in several stages.

* * * * *